US006702658B2

(12) United States Patent
Numoto

(10) Patent No.: US 6,702,658 B2
(45) Date of Patent: Mar. 9, 2004

(54) WAFER POLISHING APPARATUS UTILIZING AN OLDHAM'S COUPLING MECHANISM FOR THE WAFER CARRIER

(75) Inventor: Minoru Numoto, Mitaka (JP)

(73) Assignee: Tokyo Seimitsu Co., Ltd., Mitaka (JP)

( * ) Notice: Subject to any disclaimer, the term of this patent is extended or adjusted under 35 U.S.C. 154(b) by 162 days.

(21) Appl. No.: 09/996,797

(22) Filed: Nov. 30, 2001

(65) Prior Publication Data

US 2002/0068517 A1 Jun. 6, 2002

(30) Foreign Application Priority Data

Dec. 4, 2000 (JP) ..... 2000-368639
May 29, 2001 (JP) ..... 2001-160501

(51) Int. Cl.[7] ..... B24B 47/00
(52) U.S. Cl. ..... 451/288; 451/290; 451/398
(58) Field of Search ..... 451/41, 59, 63, 451/285, 286, 287, 288, 289, 290, 384, 385, 390, 397, 398, 402

(56) References Cited

U.S. PATENT DOCUMENTS 4,270,314 A * 6/1981 Cesna ..... 451/288
4,429,595 A * 2/1984 Butterfield ..... 475/168
4,699,023 A * 10/1987 Bajulaz ..... 475/162
4,994,005 A * 2/1991 Rennerfelt ..... 475/162
5,476,414 A * 12/1995 Hirose et al. ..... 451/288
5,694,819 A * 12/1997 Hormansdorfer ..... 82/19
6,027,401 A * 2/2000 Saito et al. ..... 451/398
6,217,411 B1 * 4/2001 Hiyama et al. ..... 451/8

FOREIGN PATENT DOCUMENTS

JP 61025767 A * 2/1986

* cited by examiner

*Primary Examiner*—Timothy V. Eley
(74) *Attorney, Agent, or Firm*—Nixon Peabody LLP; David S. Safran

(57) ABSTRACT

A rotation force of a drive shaft is transmitted from a drive plate to an intermediate plate through a first pin, and a rotation force of the intermediate plate is transmitted to a carrier through a second pin. The rotation force of the drive shaft is transmitted to the carrier through an Oldham's coupling mechanism; thereby, a wafer polishing apparatus can always rotate the carrier in a stable condition even though a wafer receives a friction force in side directions from a polishing pad because no twisting force is applied to the drive shaft.

3 Claims, 5 Drawing Sheets

WAFER POLISHING APPARATUS UTILIZING AN OLDHAM'S COUPLING MECHANISM FOR THE WAFER CARRIER

BACKGROUND OF THE INVENTION

1. Field of the Invention

The present invention relates to a wafer polishing apparatus, which polishes a wafer by a Chemical Mechanical Planarizer (CMP).

2. Description of the Related Art

In polishing by a CMP, a wafer which is rotating is pressed against a rotating polishing pad in a predetermined pressure and mechano-chemical polishing agent is supplied into a space between the polishing pad and the wafer. In this case, the wafer is pressed against the polishing pad while being held with a carrier, and the wafer receives a rotation force.

A conventional wafer polishing apparatus has three pins at the bottom of a rotating table which is connected to a drive source, and the three pins are fit into openings for the pins which are formed on the carrier, so that rotation of the driving force is transmitted to the carrier.

In fact, the wafer is generally polished at a position which is out of the center of the polishing pad; hence a friction force in side directions, acted on the wafer, affects the carrier. In the conventional wafer polishing apparatus, the force in side directions is received by the pins.

However, if the pins receive the force in side directions, polishing accuracy of the wafer deteriorates. This is because the pins receive the force while rotating and a position for receiving the force is varied, thus the carrier receives a wobbling force.

SUMMARY OF THE INVENTION

In view of the foregoing, it is an object of the present invention to provide a wafer polishing apparatus by which a wafer can be accurately manufactured.

In order to achieve the above-described object, the present invention provides a wafer polishing apparatus which polishes a surface of a wafer, comprising: a rotary shaft connected to a drive source; and a carrier that holds the wafer and presses the surface of the wafer against a polishing pad that is rotating, the carrier being connected to the rotary shaft through an Oldham's coupling mechanism.

According to the present invention, since rotation from the rotary shaft is transmitted to the carrier through the Oldham's coupling mechanism, the carrier can be rotated in a stable condition even though the carrier receives a force in side directions; thus the wafer can be accurately polished.

As described hereinabove, according to the present invention, the carrier can always rotate in a stable condition even though it receives a force in side directions, because the rotation from the rotary shaft is transmitted to the carrier through Oldham's coupling mechanism. Therefore, the wafer can be accurately polished.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Hereunder a preferred embodiment for a wafer polishing apparatus of the present invention will be described in detail in accordance with the accompanying drawings.

Figure 1:
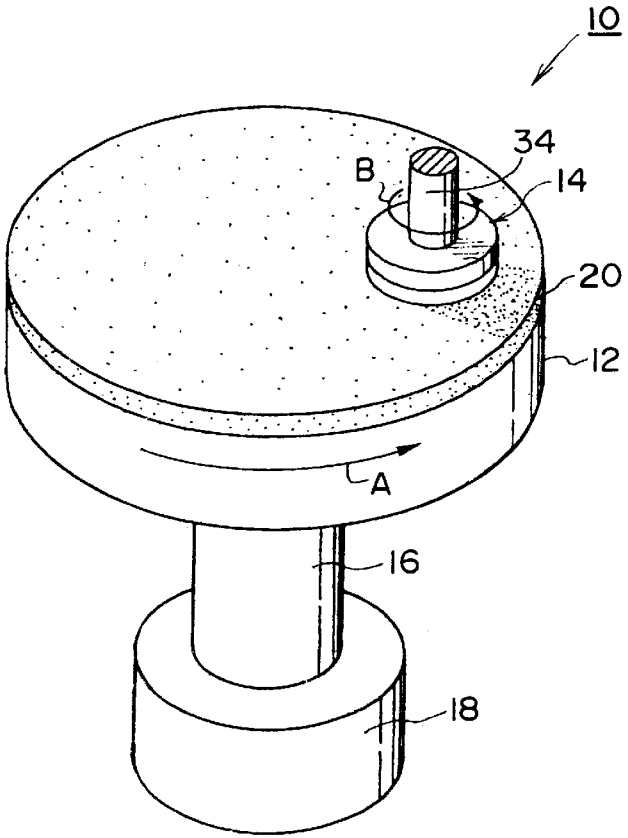
FIG. 1 is a perspective view showing an entire structure of a wafer polishing apparatus.

FIG. 1 is a perspective view showing an entire wafer polishing apparatus 10. As seen from FIG. 1, the wafer polishing apparatus 10 comprises a polishing stage 12 and a wafer holding head 14.

The polishing stage 12 is formed like a disk, and a rotary shaft 16 is connected to the bottom center of the polishing stage 12. The polishing stage 12 rotates by driving a motor 18, which is connected to the rotary shaft 16. A polishing pad 20 is adhered onto the top face of the polishing stage 12, and mechano-chemical agent is supplied from a nozzle (not shown) on the polishing pad 20.

Figure 2:
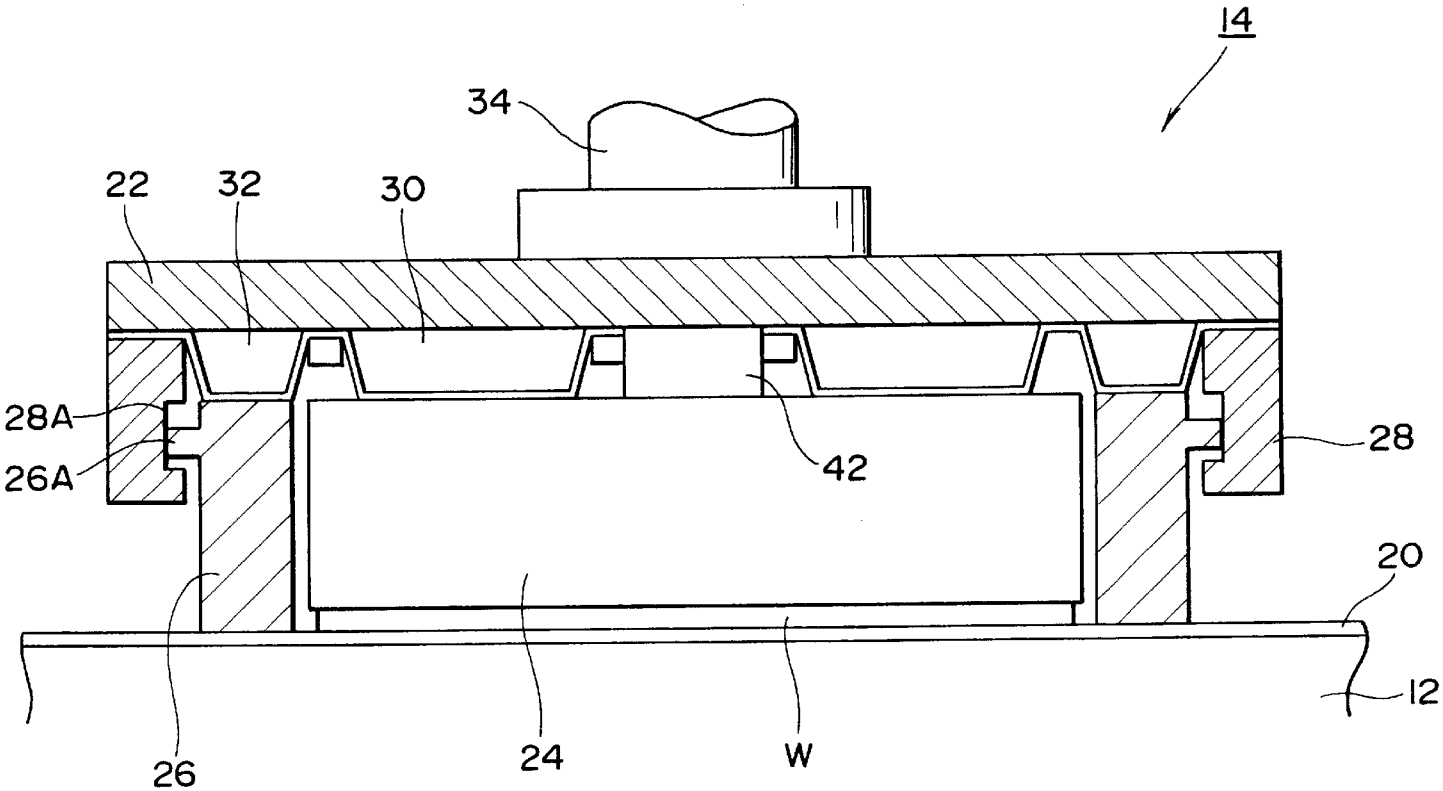
FIG. 2 is a vertical section view showing a structure of a wafer holding head.

As seen now from FIG. 2, the wafer holding head 14 comprises a head body 22, a carrier 24, a retainer ring 26, a guide ring 28, an air bag 30 for the carrier, and another air bag 32 for the retainer ring.

The head body 22 is formed like a disk, and a rotary shaft 34 is connected onto the top face of the head body 22. The head body 22 is driven by a motor (not shown) which is connected to the rotary shaft 34, whereby the head body 22 rotates in a direction of an arrow B in FIG. 1.

The carrier 24 is also formed like a disk, and is arranged at the bottom center of the head body 22. The carrier 24 is driven by a carrier driving device 36, so that the carrier 24 rotates.

The retainer ring 26 is arranged at an outer periphery of the carrier 24.

The guide ring 28, on the other hand, is arranged at an outer periphery of the retainer ring 26. The guide ring 28 is fixed to the bottom of the head body 22, and a groove 28A is formed on an inner peripheral face of the guide ring 28. A flange 26A formed on the outer peripheral face of the retainer ring 26 sits into the groove 28A, whereby the retainer ring 26 is prevented from falling off when the wafer holding head 14 is lifted.

The air bag 30 for the carrier is arranged in a space between the carrier 24 and the head body 22, and inner pressure of the air bag 30 is raised by supplying air from an air supply apparatus (not shown). The top face of the carrier 24 is pressed by the air bag 30 for the carrier, whereby a wafer W is pressed against the polishing pad 20.

The air bag 32 for the retainer ring is arranged in a space between the retainer ring 26 and the head body 22, and inner pressure of the air bag 32 is raised by supplying air from the air supply apparatus (not shown). The top face of the retainer ring 26 is pressed by the air bag 32 for the retainer ring, whereby the retainer ring 26 is pressed against the polishing pad 20.

Figure 3:
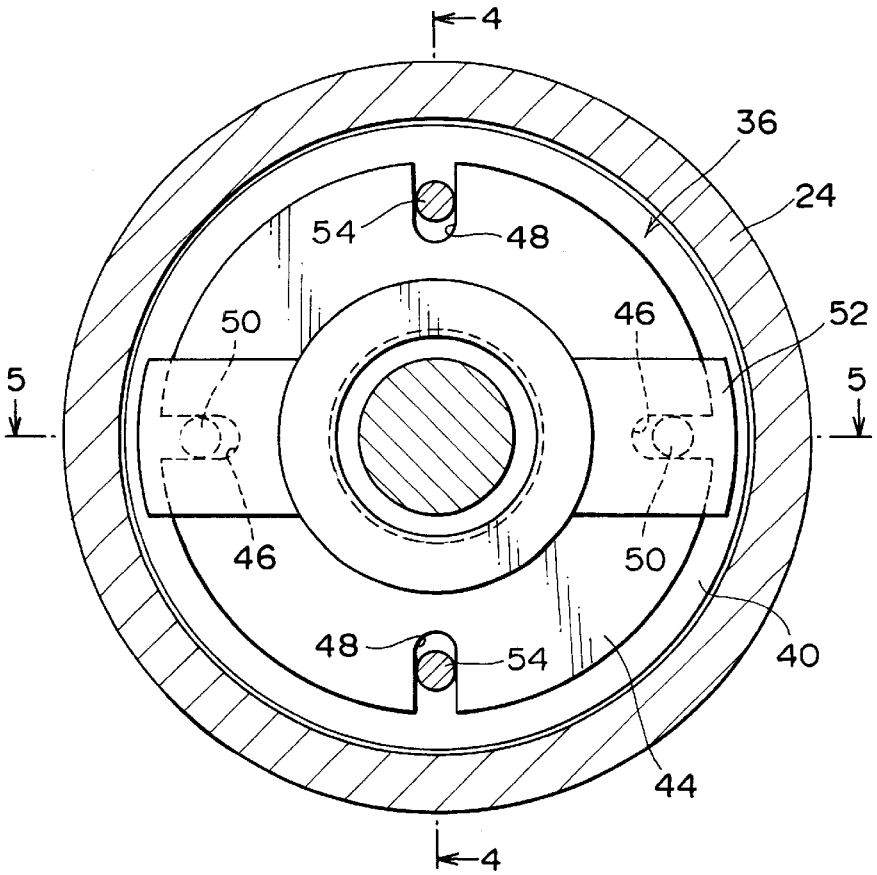
FIG. 3 is a plan view showing a structure of a carrier driving device.
Figure 4:
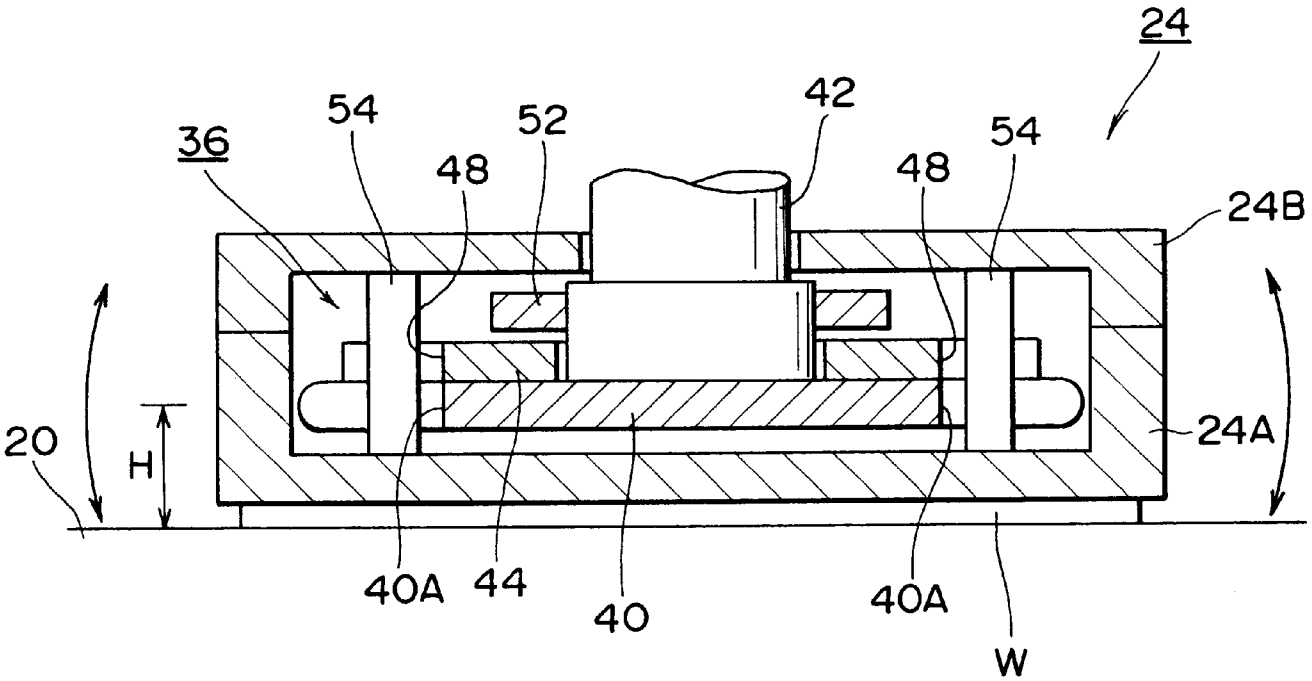
FIG. 4 is a section view along the line 4—4 of the carrier driving device in FIG. 3.
Figure 5:
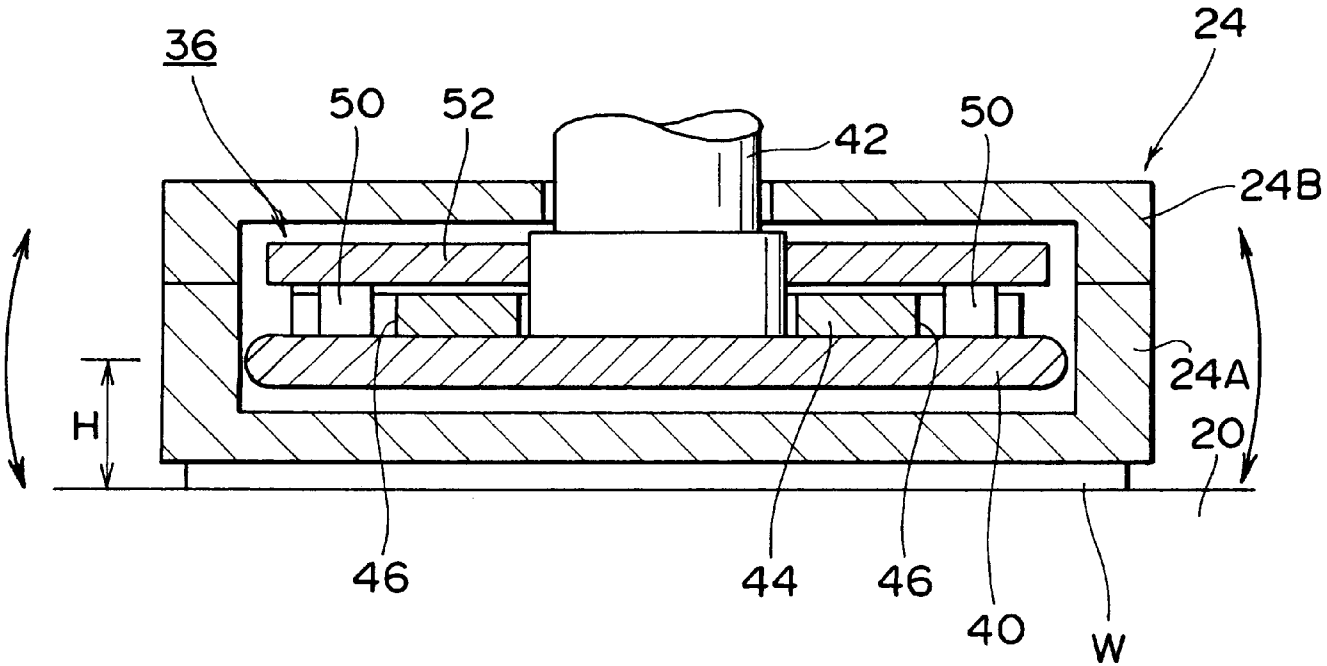
FIG. 5 is another section view along the line 5—5 of the carrier driving device in FIG. 3.

FIG. 3 is a plan view showing a structure of the carrier driving device 36. FIGS. 4 and 5 are both sectional views along the line 4—4 and the line 5—5, respectively, of the carrier driving device 36 in FIG. 3.

The carrier 24 has a hollow form, and is constructed of a carrier body 24A and a ring-shaped cover 24B which covers an opening of the top face of the carrier body 24A. The over 24B is fixed with bolts (not shown) at the top part of the carrier body 24A.

A disk-shaped drive plate (a rotation driving member) 40 is contained in an inner peripheral part of the carrier body 24A. The drive plate 40 is secured to the bottom end of a drive shaft (rotary shaft) 42, which is connected to the bottom center of the head body 22 (refer to FIG. 2). The drive plate 40 is formed to have a diameter whose size is a little smaller than that of the carrier body 24A, and its outer peripheral edge is rounded.

A ring-shaped intermediate plate (rotation transmitting member) 44 is only placed on the drive plate 40, and a drive shaft 42 is inserted with a little space through the inner peripheral part of the intermediate plate 44. First U-shaped recesses (openings for the first pins to enter) 46 and 46, and second U-shaped recesses (openings for the second pins to enter) 48 and 48 are alternatively formed at every 90 degrees interval on the outer peripheral part of the intermediate plate 44. The first U-shaped recesses 46 and the second U-shaped recesses 48 are formed in a predetermined depth from the outer periphery toward the center of the intermediate plate 44, and the recesses 46 and 48 are formed to have a wider width than a diameter of first pins 50 and 50, and second pins 54 and 54.

The first pins 50 and 50 are loosely fit into the first U-shaped recesses 46 and 46. The first pins 50 and 50 stand straight on the drive plate 40, and their top end parts are fixed to an assisting plate 52, which is elongated and is fixed to the drive shaft 42. Rotation of the drive plate 40 is transmitted to the intermediate plate 44 through the first pins 50 and 50.

On the other hand, the second pins 54 and 54 are loosely fit into the second U-shaped recesses 48 and 48. The second pins 54 and 54 stand straight on the bottom face of the inner periphery of the carrier body 24A, and their top ends are fixed to the back face of the cover 24B. Rotation of the intermediate plate 44 is transmitted to the carrier body 24A through the second pins 54 and 54.

Moreover, notches 40A and 40A having larger diameters than that of the second pins 54 are formed at two sections on the outer periphery of the drive plate 40 in order to prevent the second pins 54 and 54 from contacting with the drive plate 40. The second pins 54 and 54 are inserted through the notches 40A and 40A.

As far as the second pins 54 are prevented from contacting with the drive plate 40, openings having larger diameters than that of the second pins 54 may be formed on the drive plate 40 so that the second pins 54 are inserted through the openings.

In the carrier driving device 36 which is constructed as presented above, when the head body 22 rotates, its rotation force is transmitted to the drive shaft 42 and to the drive plate 40. When the drive plate 40 rotates, its rotation force is transmitted to the intermediate plate 44 through the first pins 50 and 50, and rotation force of the intermediate plate 44 is transmitted to the carrier body 24A through the second pins 54 and 54.

In other words, the rotation force of the drive shaft 42 in the carrier driving device 36 is transmitted to the carrier 24 by using Oldham's coupling mechanism. The carrier 24 can rotate in a stable condition even though the carrier 24 receives a force in side directions since the rotation of the drive shaft 42 is transmitted to the carrier 24 through the Oldham's coupling mechanism. More specifically, when the carrier 24 receives a force in side directions, the drive plate 40 receives the force with its outer periphery, and the first pins 50 and the second pins 54 receives the rotation force; only thus, the carrier 24 can always rotate in a stable condition by eliminating a twisting force to the drive shaft 42.

Now, an operation of the wafer polishing apparatus 10 which is constructed as described above is presented below.

First, the wafer W is held by the wafer holding head 14 and is placed on the polishing pad 20. Compressed air is supplied from an air supply apparatus (not shown) into the air bag 30 for the carrier and the air bag 32 for the retainer ring in order to raise the inner pressure of the air bags 30 and 32. The wafer W is pressed against the polishing pad 20 with the carrier 24 in a predetermined pressure whereas the retainer ring 26 is pressed against the polishing pad 20 in a predetermined pressure, both by the raised inner pressure of the air bags 30 and 32. The polishing stage 12 rotates in a direction indicated by an arrow A in FIG. 1 in that state while wafer holding head 14 rotates in a direction indicated by an arrow B in FIG. 1. Then mechano-chemical polishing agent is supplied onto the rotating polishing pad 20 from a nozzle (not shown). The bottom face of the wafer W is polished by the above-described process.

The wafer W which has been polished through the above-described process is held by the carrier 24 and is pressed against the polishing pad 20 so that rotation is given to the wafer W. The carrier 24 is driven and rotates by the carrier driving device 36, of which operation is presented below.

When the rotary shaft 34 which is connected to the head body 22 is driven by a motor (not shown) so as to rotate the head 22, the rotation is transmitted the drive shaft 42 for that to rotate. The rotation of the drive shaft 42 is transmitted now to the drive plate 40 and further to the intermediate plate 44 through the first pins 50 and 50. The rotation of the intermediate plate 44 is then transmitted to the carrier body 24A through the second pins 54 and 54, whereby the carrier 24 rotates.

In the carrier driving device 36 in the present embodiment, the carrier 24 can rotate in a stable condition since the rotation force is transmitted from the drive shaft 42 through Oldham's coupling mechanism. More specifically, when the carrier 24 receives a force in side directions, the drive plate 40 receives the force with its outer periphery, and the first pins 50 and the second pins 54 receive the rotation force only; thus, the carrier 24 can always rotate in a stable condition by eliminating a twisting force to the drive shaft 42.

Moreover, in the carrier driving device 36 in the present embodiment, the carrier 24 has a hollow form, in which the drive plate 40 is contained; hence the force from the polishing pad 20 can be received at the proximity (at the height H) of the polishing pad 20. Thus the carrier 24 can be rotated in even a more stable condition.

Further, since the outer peripheral edge of the drive plate 40 is rounded, it can absorb vibrations (inclination) of the carrier 24 throughout polishing; thus, the vibrations are prevented from being transmitted to the drive shaft 42.

According to the carrier driving device 36 in the present embodiment, the carrier 24 can rotate in a stable condition. Therefore, the wafer W can be accurately polished by eliminating overload to the wafer W and preventing the wafer W from slipping out of the machine.

In the present embodiment, the pins formed at both the drive plate and the carrier are loosely fit into U-shaped recesses that are formed at the intermediate plate in order to transmit the rotation. However, the pins formed at the intermediate plate may be loosely fit into the U-shaped recesses that are formed at the drive plate and the carrier in order to transmit the rotation.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A wafer polishing apparatus which polishes a surface of a wafer, comprising:

a rotary shaft connected to a drive source: and a carrier that holds the wafer and presses the surface of the wafer against a polishing pad that is rotating, said carrier being connected to said rotary shaft through an Oldham's coupling mechanism, wherein said Oldham's coupling mechanism comprises:

a rotation driving member provided to said rotary shaft;

a rotation transmitting member on which first openings and second openings are formed;

first pins which are provided to said rotation driving member and are loosely fit into said first openings so as to transmit the rotation force of said rotation driving member to said rotation transmitting member; and second pins which are provided to said carrier and are loosely fit into said second openings so as to transmit the rotation force of said rotation transmitting member to said carrier.

2. The wafer polishing apparatus as defined in claim 1, wherein said carrier has a hollow form, in which said rotation driving member and said rotation transmitting member are disposed.

3. The wafer polishing apparatus as defined in claim 2, wherein an outer peripheral face of said rotation driving member contacts with an inner peripheral face of a hollow part formed in said carrier, whereby said rotation driving member receives a force applied to said carrier in side directions and said first pins and said second pins receive the rotation force from said rotary shaft.

* * * * *